United States Patent [19]

Swope

[11] Patent Number: 4,595,154

[45] Date of Patent: Jun. 17, 1986

[54] PORTABLE ROLL STOCK DISPENSER

[76] Inventor: Thomas A. Swope, 791 E. 16th St., Apt. 76, Holland, Mich. 49423

[21] Appl. No.: 631,396

[22] Filed: Jul. 16, 1984

[51] Int. Cl.[4] ..... B65H 19/00; F16M 13/00

[52] U.S. Cl. ..... 242/55.53; 248/DIG. 10

[58] Field of Search ..... 242/55.2, 55.3, 55.53; D6/518, 523; 248/DIG. 10, 159; 273/209, 291; 312/38, 39, 40

[56] References Cited

U.S. PATENT DOCUMENTS

| | | | |
|---|---|---|---|
| D. 88,820 | 12/1932 | Parker | D6/420 |
| 986,955 | 3/1911 | Strom | 242/55.3 |
| 1,554,660 | 9/1925 | Ruskay | 220/20.5 |
| 2,742,241 | 4/1956 | Miller | 242/55.53 |
| 3,245,626 | 4/1966 | Casteel | 242/55.3 |
| 3,554,456 | 1/1971 | Moore | 242/55.2 |
| 4,109,910 | 8/1978 | Gleason | 248/DIG. 10 |
| 4,124,259 | 11/1978 | Harris | 312/39 |

*Primary Examiner*—Leonard D. Christian

*Attorney, Agent, or Firm*—Price, Heneveld, Huizenga & Cooper

[57] ABSTRACT

A portable molded plastic roll stock dispenser with a housing for the roll, a supporting pedestal and a hollow base which can be filled with ballast. The housing has flexible tabs formed in the sidewalls thereof, with projecting stubs which engage the open ends of the core of a roll.

17 Claims, 3 Drawing Figures

PORTABLE ROLL STOCK DISPENSER

BACKGROUND OF THE INVENTION

This invention relates to paper towel, toilet paper or like roll stock dispensers for use in bathrooms, kitchens, work areas and the like.

One type of roll stock dispenser which is available on the market is attached directly to a room wall or to the side of a cabinet or cupboard. This type of dispenser is generally quite stable and will not move when a sheet of paper or tissue is pulled from the roll stock. However, such dispensers are not portable since they are affixed directly to a wall and thus cannot be easily moved from one location to another.

The lack of portability of such dispensers has been recognized and a number of solutions have been proposed. For example, U.S. Pat. No. 3,554,456 to Moore discloses a toilet tissue dispenser having a base made of a solid metal, such as cast-iron or steel, to weight a bathroom tissue roll support frame. A support frame extends upwardly from the base and supports a toilet roll stock. U.S. Pat. No. 4,124,259 to Harris discloses a freestanding, cabinet-like tissue paper dispenser. The cabinet is made out of wood or sheet metal. The Moore and Harris dispensers, though movable, are not very portable because they are fairly heavy. Further, the dispensers are expensive to manufacture because they are made out of metal or wood.

Therefore, a need exists for a roll stock dispenser which is lightweight for easy moving yet stable during use. A need also exists for a dispenser which is inexpensive to manufacture and sell.

SUMMARY OF THE INVENTION

The roll stock dispenser of the present invention is both highly stable and very portable. It includes a base, a roll support housing and means extending from the base to the housing to support same. The base is hollow and is provided with a hole so that ballast material such as sand or water can be poured into the interior of the base to stabilize the dispenser. The amount of ballast material poured into the base can be controlled to insure that the base is heavy enough to stabilize the dispenser yet light enough to permit the dispenser to be easily moved.

The roll stock of the present invention has the advantages of being very stable yet very portable. Further, the dispenser, since it is made out of inexpensive plastic and uses sand or water to weight the base, is quite inexpensive to manufacture.

DESCRIPTION OF THE PREFERRED EMBODIMENT

Figure 3:
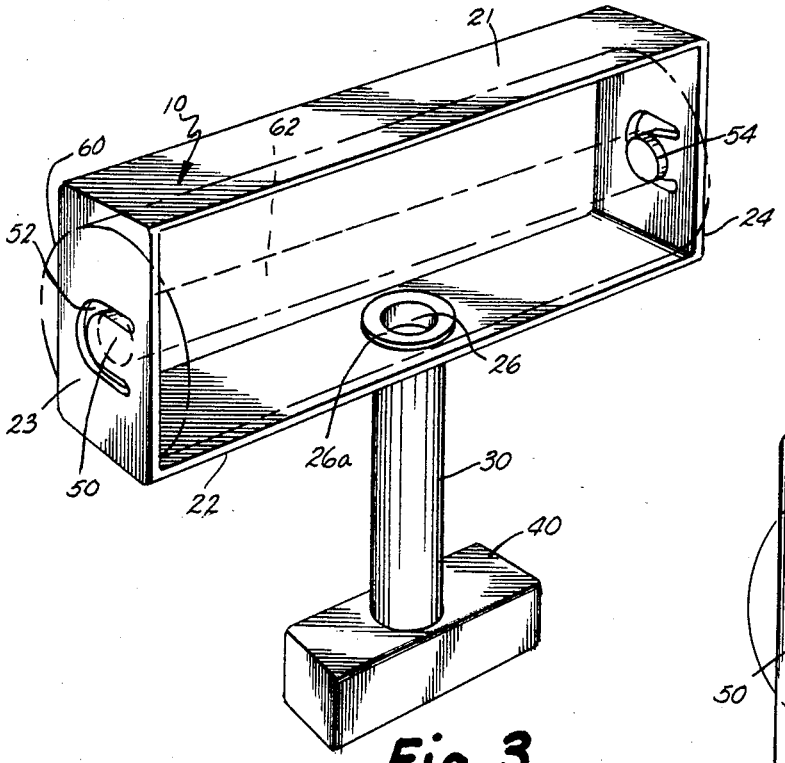
FIG. 3 is a front view of the embodiment of FIG. 1 with the base and pedestal portions shown in cross section.

The portable and stable roll stock dispenser 10 of the present invention is comprised of a base 40 having a hollow interior, a hollow, cylindrical pedestal or frame 30 projecting upwardly therefrom and a roll stock support housing 20 secured to the upper end of pedestal 30. Spaced sidewalls 23, 24 of housing 20 are provided with flexible tabs 50 which have stubs 54 projecting perpendicularly from tabs 50 toward the interior of housing 20. Roll stock 60 is mounted in housing 20 by flexing tabs 50 outwardly and by engaging stubs 54 into each end of cylindrical cardboard roll 62 of roll stock 60. The hollow interior of base 40 is filled with ballast material 70 which stabilizes dispenser 10 when paper is pulled from roll 60.

Figure 2:
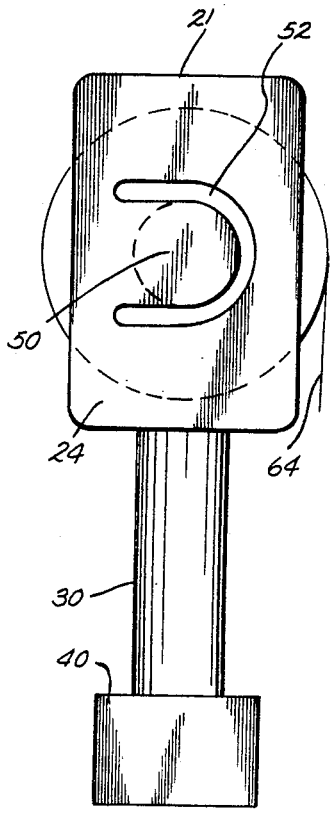
FIG. 2 is a side view of the invention.
Figure 1:
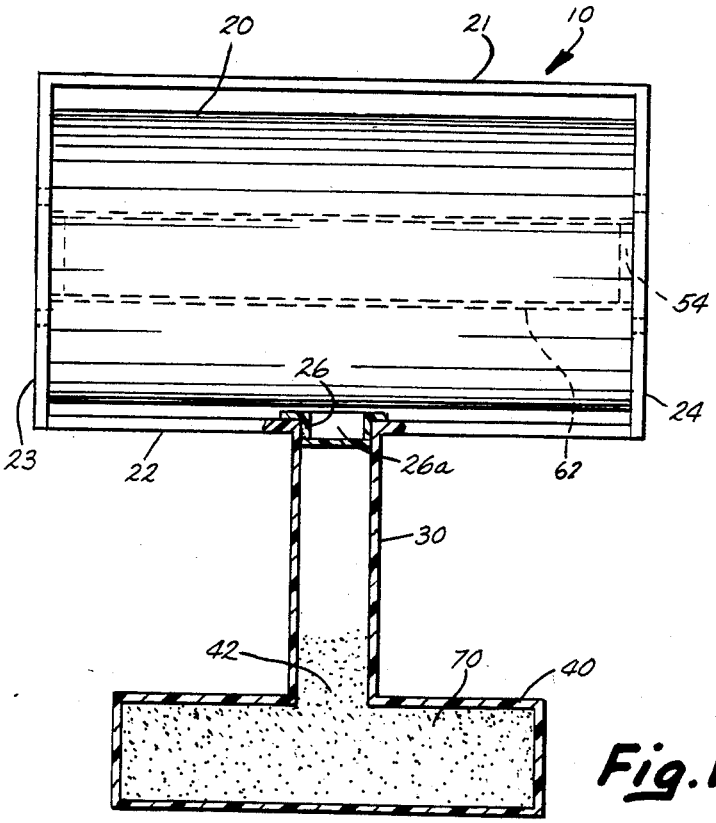
FIG. 1 is a perspective view of the roll stock dispenser of the present invention.

Dispenser 10 is preferably integrally molded of a lightweight plastic material. Rotational molding or blowmolding techniques could be used. Any lightweight, inexpensive plastic having a degree of structural integrity and flexibility would be suitable. Base 40 has a hollow interior and is preferably rectangular in shape. The upper surface of base 40 from which pedestal 30 projects, is provided with an orifice 42. As can be seen in FIGS. 1 and 2, the length and width of base 40 is preferably less than the length and width of roll support housing 20. The compactness of base 40 permits dispenser 10 to be set on small flat surfaces such as countertops or small tabletops.

Pedestal 30 has a hollow interior and is open at both ends. Pedestal 30 is located on base 40 such that hole 42 lies within the interior of the open bottom end. Orifice 42 provides a passageway between the hollow interior of base 40 and the hollow interior of pedestal 30. Preferably, pedestal 30 is cylindrical in shape. It should be understood that pedestal 30 can have a variety of shapes and/or lengths depending on the particular design.

Roll stock support housing 20 is in the form of an open-faced box having an upper wall 21 and a lower wall 22 which are connected to each other by spaced sidewalls 23 and 24. Upper wall 21 helps rigidify sidewalls 23 and 24 without having to unduly beef up the thickness or rigidity of bottom wall 22 and sidewalls 23 and 24.

Lower wall 22 of housing 20 is provided with a hole 26 which opens into the open end of pedestal 30. Hole 26 provides an opening for pouring ballast material 70 such as sand, gravel or water into the interior of pedestal 30 and base 40. A removable plug **26*a* (FIG. 3) can be used to seal hole 26 and prevent ballast spill in the event of an inadvertent tip-over. Ballast material 70 weights base 40 thereby stabilizing dispenser 10 so as to prevent dispenser 10 from tipping over when a sheet of paper is pulled from roll stock 60**. The preferred ballast material is sand or water.

Sidewalls 23 and 24 are provided with tabs 50 which are formed from and are part of the sidewall to which they are integrally connected. Tabs 50 are formed by cutting or stamping a C-shaped slot 52 out of sidewalls 23, 24 (FIGS. 2, 3), or possibly by molding dispenser 10 with the slots in place. Tab 54 is thus a peninsula of sidewalls 23 or 24 which lies within the area defined by C-shaped groove 52. The base of tab 50 remains integrally connected to the body of sidewalls 23 or 24. Tab 50 is able to flex inwardly or outwardly with respect to the plane of said sidewall because it is constructed out of the same flexible material of the sidewall.

Groove 52 is preferably C-shaped in order to avoid the presence of sharp corners. It should be understood, however, that groove 52 could be V-shaped or U-shaped if so desired.

Roll engaging stubs 54 are molded into the inner surface of tabs 50 and extend perpendicularly therefrom toward the interior of housing 20. Roll stock 60 is mounted onto housing 20 by flexing tabs 50 outwardly and by engaging stubs 54 into each end of core 62 of roll stock 60. When the supply of paper from that roll is exhausted, the empty roll is removed by flexing tabs 50 outwardly and disengaging stubs 54 from each end of core 62.

The dimensions of housing 20 will vary depending on the type of roll it is intended to house. For toilet paper, for example, end walls 23 and 24 will be closer together than would be the case if dispenser 10 were for paper toweling.

The roll stock support and mounting system of the present invention is durable and easy to use because the number of moving parts is kept to a minimum. In addition, the system is easy and inexpensive to manufacture because tabs 50 are molded from the same flexible material used to form sidewalls 23, 24.

The user would purchase dispenser 10 without ballast. He or she would then pour water or sand into opening 26 at the top of pedestal 30 until base 40 is filled. Preferably, dispenser 10 is made of a plastic which is at least slightly translucent so that it can be held up to a source of light and the level of ballast determined. One does not want to fill to the top of pedestal 30 as that would tend to increase top heaviness.

The user could then locate dispenser 10 in any convenient location, e.g., workshop, garage, kitchen, bathroom and the like. When used as roll stock dispenser, portability is particularly desirable as it enables one to take a convenient supply of toweling to the job site without having to worry about setting a roll down in the dirt or in a pool of water, oil or the like.

Having described a preferred embodiment of the invention, it is understood that various changes can be made without departing from the invention as defined in the appended claims.

The embodiments of the invention in which an exclusive property or privilege is claimed are defined as follows:

1. A roll stock dispenser, comprising:

a base having a hollow interior which is adapted for containing therein a ballast material;

a roll stock support housing;

means for supporting said housing above said base connected at one end to said base and at the other end to said housing;

an opening in said base to facilitate filling said base with said ballast material; and means in said support housing for supporting roll stock therein.

2. The dispenser of claim 1 which is integrally molded of plastic.

3. The roll stock dispenser of claim 1 wherein said base is smaller in horizontal cross sectional area than said roll support housing.

4. A roll stock dispenser as recited in claim 3 wherein said means for supporting said roll comprises:

said housing including spaced first and second sidewalls, at least said first sidewall including a cantilevered tab having a base integral with said sidewall and a body separated from said sidewall by an arcuate slot located in and extending through said sidewall;

means attached to said tab and means attached to said second sidewall for engaging the core of said roll.

5. A roll stock dispenser as recited in claim 4 wherein said means attached to said tab and said means attached to said second sidewall for engaging the core of said roll comprise stubs, a first stub attached to said tab and extending perpendicularly therefrom toward said second sidewall and a second stub attached to said second sidewall and extending perpendicularly therefrom toward said first sidewall, whereby said roll is mounted on said support housing by flexing said tab outwardly and engaging said first and second stubs into the ends of the core of said roll stock.

6. A roll stock dispenser as recited in claim 5 wherein said cantilevered tab is C-shaped.

7. A roll stock dispenser as recited in claim 6 wherein:

said means for supporting said housing above said base comprises a hollow pedestal;

said pedestal being located over said opening in said base;

said housing having an opening into said pedestal, whereby said base is filled and weighted by pouring ballast material into said opening in said housing, said ballast material flowing through said hollow interior of said pedestal, through said opening in said base, and into said hollow interior of said base.

8. A roll stock dispenser as recited in claim 7 wherein said base is rectangular in shape and wherein the length and width of said rectangular base are less than the length and width of said housing.

9. The dispenser of claim 8 which is integrally molded of plastic.

10. The dispenser of claim 4 which is integrally molded of plastic.

11. A roll stock dispenser as recited in claim 1 wherein:

said means for supporting said housing above said base comprises a hollow pedestal;

said pedestal being located over said opening in said base;

said housing having an opening into said pedestal, whereby said base is filled and weighted by pouring ballast material into said opening in said housing, said ballast material flowing through said hollow interior of said pedestal, through said opening in said base, and into said hollow interior of said base.

12. A roll stock dispenser as recited in claim 1 wherein said means for supporting said roll comprises:

said housing including spaced first and second sidewalls, at least said first sidewall including a cantilevered tab having a base integral with said sidewall and a body separated from said sidewall by an arcuate slot located in and extending through said sidewall;

means attached to said tab and means attached to said second sidewall for engaging the core of said roll.

13. A roll stock dispenser as recited in claim 12 wherein said means attached to said tab and said means attached to said second sidewall for engaging the core of said roll comprise stubs, a first stub attached to said tab and extending perpendicularly therefrom toward said second sidewall and a second stub attached to said second sidewall and extending perpendicularly therefrom toward said first sidewall, whereby said roll is mounted on said support housing by flexing said tab outwardly and engaging said first and second stubs into the ends of the core of said roll stock.

14. The roll stock dispenser of claim 11 wherein said base is smaller in horizontal cross sectional area than said roll support housing.

15. A roll stock dispenser as recited in claim 11 wherein said base is rectangular in shape and wherein the length and width of said rectangular base are less than the length and width of said housing.

16. The roll stock dispenser as recited in claim 7 wherein said hollow pedestal and housing provide an unobstructed passage for granular ballast to be introduced through said hollow pedestal into said base; said pedestal having an opening into it near its upper end to allow granular ballast to be introduced into said hollow pedestal.

17. The roll stock dispenser as recited in claim 16 wherein said housing includes a bottom wall connecting said sidewalls below said cantilevered tab, said pedestal connecting to said bottom wall for supporting said housing, said bottom wall having said housing opening through it communicating with the interior of said pedestal, and a cap removably positioned over said housing opening, whereby a roll of paper stock positioned in said housing will be located over said cap and housing opening to substantially conceal said cap and opening from view.

* * * * *